US005375345A

United States Patent [19]

Djuric

[11] Patent Number: 5,375,345

[45] Date of Patent: Dec. 27, 1994

[54] SHOE WITH INTEGRAL REVERSIBLE AIR PUMP

[76] Inventor: Zoran Djuric, 100 Wind Garden Ct., Apt. 116, Scarborough, Ontario, Canada, M1B 2P4

[21] Appl. No.: 128,162

[22] Filed: Sep. 29, 1993

[51] Int. Cl.[5] ..... A43B 7/06

[52] U.S. Cl. ..... 36/3 B; 36/3 R

[58] Field of Search ..... 36/3 R, 3 B, 29, 3 A; 2/DIG. 1

[56] References Cited

U.S. PATENT DOCUMENTS

| | | | |
|---|---|---|---|
| 1,742,772 | 1/1930 | Langan et al. | 36/3 B |
| 2,668,372 | 2/1954 | Wright | 36/3 R |
| 2,725,646 | 12/1955 | Schmidt | 36/3 R |
| 4,224,746 | 9/1980 | Kim | 36/3 B |
| 4,654,982 | 4/1987 | Lee | 36/3 B |
| 4,993,173 | 2/1991 | Gardiner | 36/3 R |
| 5,010,661 | 4/1991 | Chu | 36/3 B |
| 5,025,575 | 6/1991 | Lakic | 36/44 |
| 5,195,254 | 3/1993 | Tyng | 36/3 B |

FOREIGN PATENT DOCUMENTS

| | | | |
|---|---|---|---|
| 0350103 | 1/1990 | European Pat. Off. | 36/3 R |
| 1108108 | 5/1961 | Germany | 36/3 R |
| 2193080 | 2/1988 | United Kingdom | 36/3 R |
| 2238706 | 6/1991 | United Kingdom | 36/3 B |

*Primary Examiner*—Steven N. Meyers

*Attorney, Agent, or Firm*—Rhodes & Ascolillo

[57] ABSTRACT

In a preferred embodiment, a positively ventilated shoe, including: an air pump disposed in the shoe to provide a flow of air; and apparatus to selectively reverse direction of the flow of air to pump air into or pump air out of the shoe.

2 Claims, 2 Drawing Sheets

SHOE WITH INTEGRAL REVERSIBLE AIR PUMP

BACKGROUND OF THE INVENTION

1. Field of the Invention

The present invention relates to shoes generally and, more particularly, but not by way of limitation, to a novel sole for shoes which includes an integral reversible air pump.

2. Background Art

Shoes typically enclose the feet of a wearer and are typically rather well sealed around the feet, thus preventing the ingress and/or egress of any substantial quantity of air. Some types of athletic shoes include grommet-like openings through the side thereof intended to provide some degree of ventilation; however, the degree of ventilation is limited by the fact that there is nothing that is actually forcing a substantial quantity of air through the openings.

The lack of adequate ventilation in most shoes leads to the trapping of heat and moisture, a very welcome environment for the growth of organisms and odors which can be offensive to other persons and, perhaps, to the wearer also. A variety of powders and sprays have been developed to combat the growth of organisms and odors; however, the useful life of a single application thereof is limited and some persons have skin reactions thereto.

In U.S. Pat. No. 5,025,575, issued Jun. 25, 1991, to Lakic, there is described an inflatable inner sole which is formed with upper and lower membranes scaled around the peripheral edges thereof to create a sealed hollow interior. A plurality of discontinuous seams are formed between the upper and lower membranes to create a plurality of interconnected passageways in the hollow interior. A pump is provided in the heel portion of the inner sole to inflate the inner sole as a wearer walks. A plurality of vertical apertures are formed through the discontinuous seams so that air will flow back and forth between the interior of the shoe above and below the inner sole. In one embodiment, a blower may be provided in the same manner as the pump in the heel portion to blow fresh air underneath the inner sole and up through the apertures.

No known shoe has therein means to selectively introduce air into the shoe or expel air therefrom.

Accordingly, it is a principal object of the present invention to provide a ventilated shoe, which shoe includes means to selectively pump air into the shoe or expel air therefrom.

It is a further object of the invention to provide such a shoe which is comfortable.

It is an additional object of the invention to provide means for effecting such ventilation which can be economically and easily incorporated into the shoe at the time of manufacture.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a positively ventilated shoe, comprising: an air pump disposed in said shoe to provide a flow of air; and means to selectively reverse direction of said flow of air to pump air into or pump air out of said shoe.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
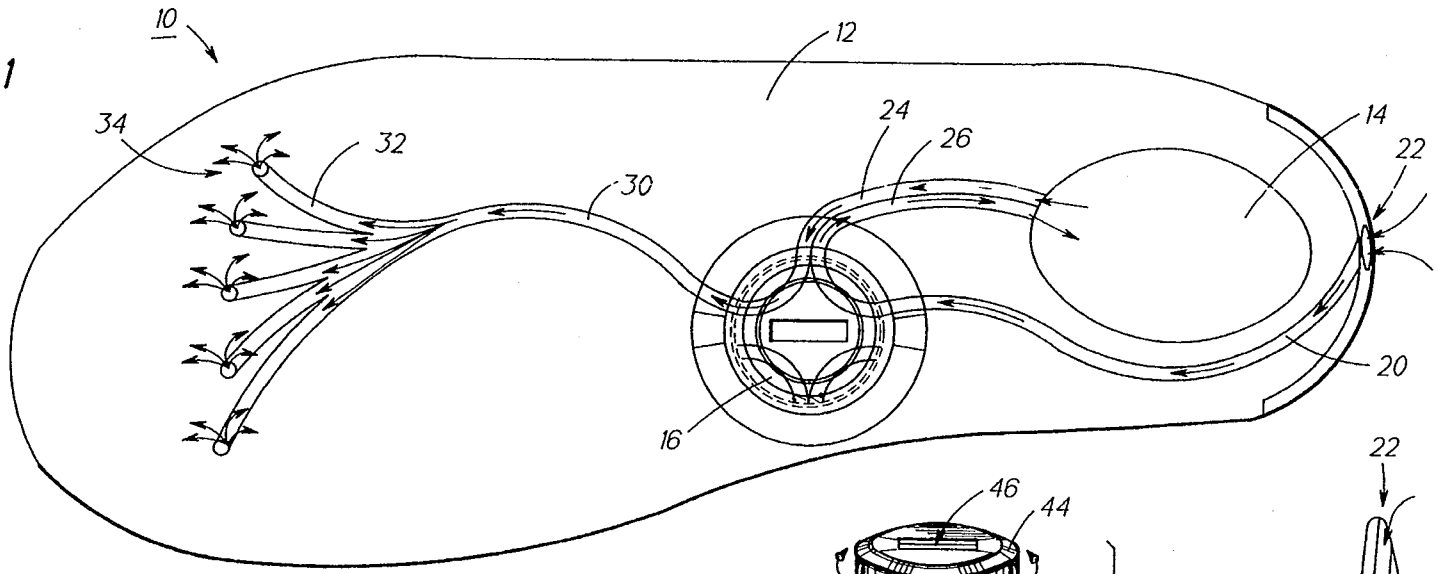
FIG. 1 is a fragmentary, cut-away, top plan view of a shoe incorporating the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
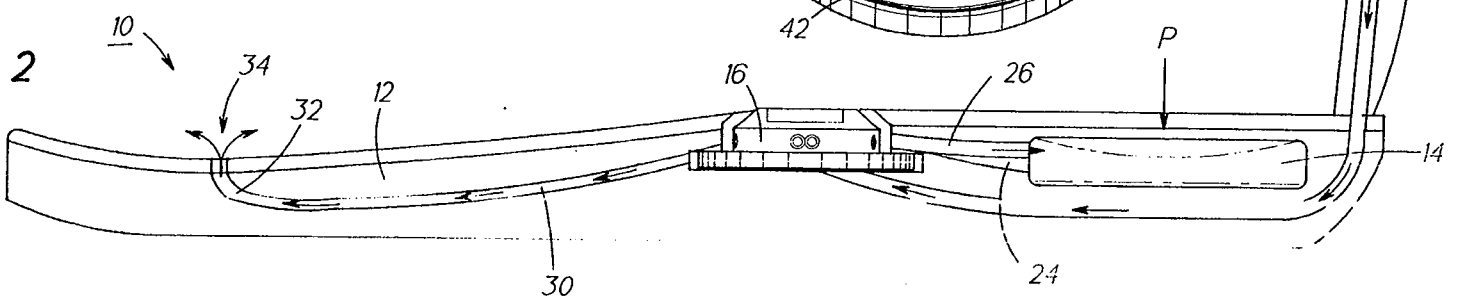
FIG. 2 is a fragmentary, cut-away, side elevational view of the shoe of FIG. 1.

FIGS. 1 and 2 illustrate a shoe, generally indicated by the reference numeral 10, incorporating the present invention. Shoe 10 includes a sole 12 having an air bag 14 disposed in a cavity formed in the heel portion thereof and an air flow selector switch 16 disposed in a cavity formed in the instep portion thereof. An inlet/-outlet passageway 20 extends from an opening 22 defined in an upper portion, preferably the highest part, of shoe 10, to air flow selector switch 16. A pair of passageways 24 and 26 interconnect air bag 14 and air flow selector switch 16. An arterial passageway 30 extends from air flow selector switch 16 to the forward portion of sole 12 where it splits into a plurality of subpassageways, as at 32, each of which terminates in an aperture, as at 34, at the upper surface of sole 12.

Figure 3:
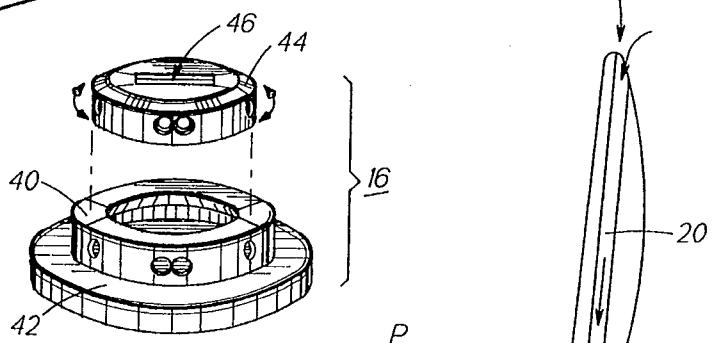
FIG. 3 is an exploded perspective view of a flow selector switch employed in the present invention.

FIG. 3 illustrates flow air flow selector switch 16 which includes a fixed base member 40, disposed in a retaining ring 42, and a rotatable member 44 which is selectively rotatable within the fixed base member 40. Rotatable member 44 can be rotated within base member 40 by inserting a coin or screwdriver (neither shown) into a slot 46 defined in the upper surface of the rotatable member and twisting the coin or screwdriver.

It will be understood that as a wearer of shoe 10 steps on a surface, air bag 14 will be compressed by the pressure "P" (FIG. 2) of the heel of the wearer and air will be expelled from the air bag. As a wearer of shoe 10 raises the shoe from a surface, such as in walking or running, air bag 14 will be restored to its uncollapsed state while air will be drawn into the bag.

Figure 4:
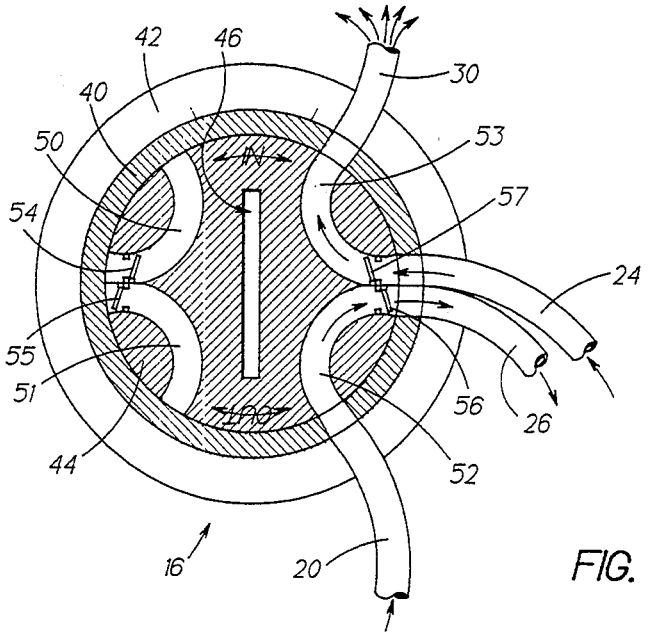
FIG. 4 is a cross-sectional, top plan view of the flow selector switch of FIG. 3 set to introduce air into a shoe.
Figure 5:
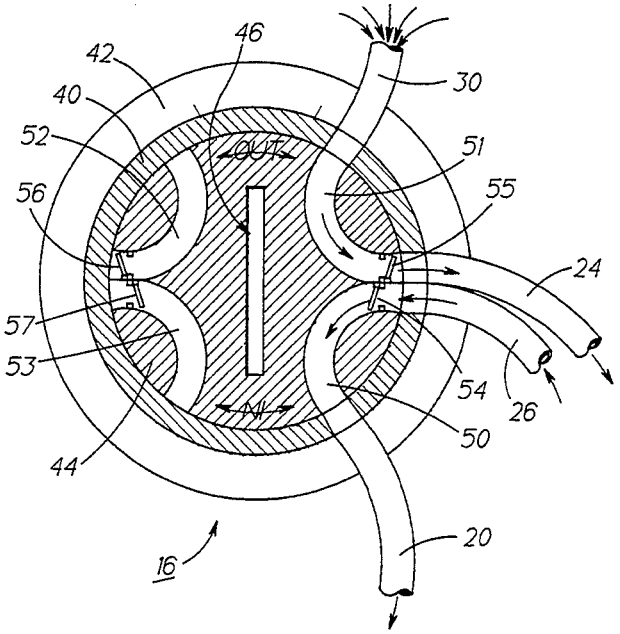
FIG. 5 is a cross-sectional, top plan view of the flow selector switch of FIG. 3 set to expel air from a shoe.

Reference also now to FIGS. 4 and 5 will aid in understanding how air bag 14 and air flow selector switch 16 cooperate to form a pump and how the air flow selector switch 16 is employed to select the direction of air flow.

Inspection of FIGS. 4 and 5 reveals that rotatable member 44 has defined therein four arcuate passageways 50–53, having disposed therein flapper type check valves 54–57, respectively. Passageways 20, 24, 26, and 30 terminate at openings defined in fixed base member 40.

FIG. 4 illustrates the setting of air flow selector valve 16 when it is desired to pump air into shoe 10, which is in accordance with the flow arrows on FIG. 1. In this case, when air bag 14 (FIGS. 1 and 2) is compressed, air will flow out of the air bag, through passageway 20, through open check valve 57 (FIG. 4), through interior passageway 53 into arterial passageway 30, through subpassageways 32 (FIGS. 1 and 2), and out of apertures 34 into shoe 10. Air will also try to flow out of air bag 14 through passageway 26, but will be prevented from doing so by the closing of check valve 56 in interior passageway 52. When pressure on air bag 14 is released, check valve 57 will close, check valve 56 will open, and fresh air will be drawn into the air bag through passageway 20 from opening 22. Such action continues, pumping fresh air into shoe 10 and expelling moisture and warm air through openings in the shoe or around the foot of the wearer.

FIG. 5 illustrates the setting of air flow selector switch when it is desired to pump air out of shoe 10. This mode of operation is particularly desirable when the wearer is in rainy or dusty conditions. Pulling air through openings in shoe 10 and around the foot of the wearer tends to filter out water drops and dust particles. Here, it can be seen that rotatable member 44 has been rotated 180 degrees from its position on FIG. 4. This puts interior passageways 50 and 51 in working position and has the effect of reversing check valve action. Now, when air bag 14 is compressed, check valve 55 will close and check valve 54 will open, and air will be expelled from the bag through passageway 26, through check valve 54, through internal passageway 50 to passageway 20, and out of opening 22. When pressure on air bag 14 is released, check valve 54 will close and check valve 55 will open, and air will be drawn from the interior of shoe 10 through apertures 34, through subpassageways 32, through arterial passageway 30, through internal passageway 51 to passageway 24, and into the air bag.

Figure 6:
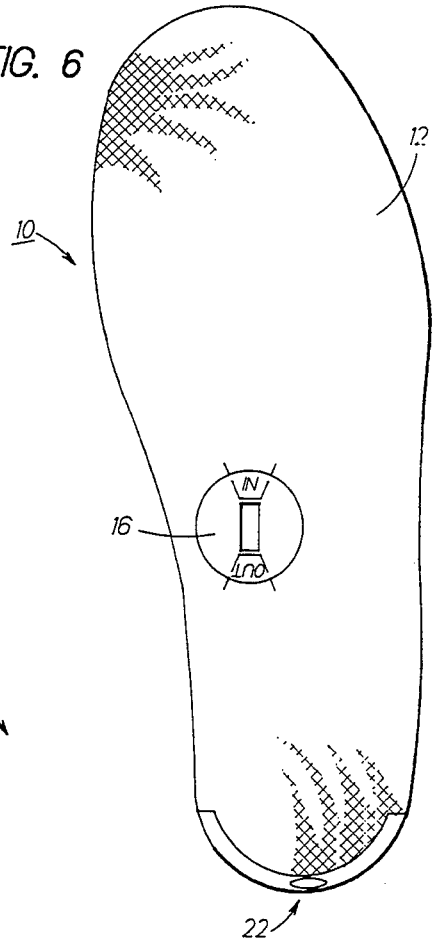
FIG. 6 is a top plan view of the shoe sole of FIGS. 1 and 2.

FIG. 6 illustrates a top view of sole 12 and it can be seen that the exterior of the sole is of conventional form, except for access to air flow selector switch 16.

The components of the present invention can be economically formed from suitable synthetic materials and the invention can easily be incorporated into shoe 10 at the time of manufacture of the shoe. Passageways 20, 24, 26, 30, and 32 can be individual sections of tubing or they can be molded into sole 12, depending on the type of construction of the sole.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A positively ventilated shoe having a sole, said shoe comprising:

(a) a collapsible air bag disposed in a cavity defined in a heel portion of said sole;

(b) an air flow selector switch disposed in a cavity defined in said sole;

(c) a first passageway connecting said air flow selector switch and an opening defined in an outer surface of said shoe;

(d) second and third passageways interconnecting said air flow selector switch and said air bag;

(e) a fourth passageway connecting said air flow selector switch and a plurality of apertures defined in an upper surface of said sole;

(f) said air flow selector switch having therein first and second pairs of internal passageways, each said passageway having therein a check valve; and (g) said air flow selector switch having first and second positions to selectively connect said first pair of said internal passageways with said first through fourth passageways or to connect said second pair of internal passageways with said first through fourth passageways.

2. A positively ventilated shoe, as defined in claim 1, wherein:

(a) when said air flow selector switch is in said first position, collapsing of said air bag will cause air to be expelled through said second passageway, through an open said check valve, through one of said first pair of internal passageways, through said fourth passageway, and out of said plurality of apertures; and, restoring of said air bag will cause air to be drawn through said opening, through said first passageway, through the other of said first pair of internal passageways, through an open check valve, through said third passageway, and into said air bag; and (b) when said air flow selector switch is in said second position, collapsing of said air bag will cause air to be expelled through said third passageway, through an open said check valve, through one of said second pair of internal passageways, through said first passageway, and out of said opening; and, restoring of said air bag will cause air to be drawn through said plurality of apertures, through said fourth passageway, through the other of said second pair of internal passageways, through an open check valve, through said second passageway, and into said air bag.

* * * * *